US006737009B2

(12) United States Patent
Taylor et al.

(10) Patent No.: US 6,737,009 B2
(45) Date of Patent: May 18, 2004

(54) PROCESS AND SYSTEM FOR PRODUCING MULTICOMPONENT SPUNBONDED NONWOVEN FABRICS

(75) Inventors: Thomas B. Taylor, Greer, SC (US); Robert C. Alexander, Brush Prairie, WA (US)

(73) Assignee: BBA Nonwovens Simpsonville, Inc., Greenville, SC (US)

( * ) Notice: Subject to any disclaimer, the term of this patent is extended or adjusted under 35 U.S.C. 154(b) by 190 days.

(21) Appl. No.: 09/921,218

(22) Filed: Aug. 2, 2001

(65) Prior Publication Data

US 2002/0063364 A1 May 30, 2002

Related U.S. Application Data

(60) Provisional application No. 60/222,892, filed on Aug. 3, 2000.

(51) Int. Cl.[7] ..... D01D 5/098; D01D 5/32; D01D 5/34; D01D 5/36; D04H 3/10

(52) U.S. Cl. ..... 264/555; 156/167; 156/181; 156/441; 264/103; 264/172.12; 264/172.13; 264/172.14; 264/172.15; 264/210.8; 264/211.12; 264/571; 425/66; 425/72.2; 425/131.5; 425/377; 425/378.2; 425/379.1; 425/382.2; 425/404; 425/463

(58) Field of Search ..... 264/103, 172.12, 264/172.13, 172.14, 172.15, 210.8, 211.12, 555, 571; 425/66, 72.2, 131.5, 377, 378.2, 379.1, 382.2, 404, 463; 156/167, 181, 441

(56) References Cited

U.S. PATENT DOCUMENTS

| | | | |
|---|---|---|---|
| 5,162,074 | A | 11/1992 | Hills |
| 5,344,297 | A | 9/1994 | Hills |
| 5,466,410 | A | 11/1995 | Hills |
| 5,783,503 | A | 7/1998 | Gillespie et al. |
| 5,814,349 | A | 9/1998 | Geus et al. |

FOREIGN PATENT DOCUMENTS

| | | | |
|---|---|---|---|
| WO | WO 97 49854 | A | 12/1997 |
| WO | WO 99 19131 | A | 4/1999 |
| WO | WO 00 08243 | A | 2/2000 |

*Primary Examiner*—Leo B. Tentoni
(74) *Attorney, Agent, or Firm*—Alston & Bird LLP

(57) ABSTRACT

A system and process for producing spunbond nonwoven fabric in which two or more polymeric components are separately melted and are separately directed through a distribution plate configured so that the separate molten polymer components combine at a multiplicity of spinnerette orifices to form filaments containing the two or more polymer components. Multicomponent filaments are extruded from the spinnerette orifices into a quench chamber where quench air is directed from a first independently controllable blower and into contact with the filaments to cool and solidify the filaments. The filaments and the quench air are directed into and through a filament attenuator and the filaments are pneumatically attenuated and stretched. The filaments are directed from the attenuator into and through a filament depositing unit and are deposited randomly upon a moving continuous air-permeable belt to form a nonwoven web of substantially continuous filaments. Suction air from a second independently controllable blower beneath the air-permeable belt so is drawn through the depositing unit and through the air-permeable belt and web is then directed through a bonder for bonding the filaments to convert the web into a coherent nonwoven fabric.

16 Claims, 1 Drawing Sheet

PROCESS AND SYSTEM FOR PRODUCING MULTICOMPONENT SPUNBONDED NONWOVEN FABRICS

CROSS-REFERENCE TO RELATED APPLICATION

This application is related to and claims priority from U.S. Provisional Patent Application No. 60/222,892 filed Aug. 3, 2000.

FIELD OF THE INVENTION

This invention relates to improvements in the manufacture of spunbonded nonwoven fabrics, and more particularly to an improved process and system for producing multicomponent spunbond fabric and to the fabrics produced therefrom.

SUMMARY OF THE INVENTION

The present invention combines several commercially available filament formation and processing technologies to achieve unique and advantageous product and process characteristics. The invention provides non-woven fabrics with an unexpectedly superior balance of softness, strength, formation and cost. The process for making these fabrics offers flexibility and product design coupled with superior formation and low cost not heretofore provided or suggested in the art.

According to the present invention, a process for producing spunbond nonwoven fabrics is provided, comprising the steps of:

a) separately melting two or more polymeric components;

b) separately directing the two or more molten polymer components through a spin beam assembly equipped with distribution plate configured so that the separate molten polymer components combine at a multiplicity of spinnerette orifices to form filaments containing the two or more polymer components;

c) extruding the multicomponent filaments from the spinnerette orifices into a quench chamber;

d) directing quench air from a first independently controllable blower into the quench chamber and into contact with the filaments to cool and solidify the filaments;

e) directing the filaments and the quench air into and through a filament attenuator and pneumatically attenuating and stretching the filaments;

f) directing the filaments from the attenuator into and through a filament depositing unit;

g) depositing the filaments from the depositing unit randomly upon a moving continuous air-permeable belt to form a nonwoven web of substantially continuous filaments;

h) applying suction from a second independently controllable blower beneath the air-permeable belt so as to draw air through the depositing unit and through the air-permeable belt; and i) directing the web through a bonder and bonding the filaments to convert the web into a coherent nonwoven fabric.

The present invention also provides a system for manufacturing spunbond nonwoven fabrics. The system includes a combination of the following elements:

a) two or more extruders for separately melting, respectively, two or more polymer components;

b) a spin beam assembly connected to said extruders for separately receiving the molten polymer components therefrom, said spin beam assembly including a spinnerette plate defining a multiplicity of spinnerette orifices, and a distribution plate configured so that the separate molten polymer components combine at the spinnerette orifices to form multicomponent filaments;

c) a quench chamber positioned adjacent to the spin beam assembly for receiving filaments extruded from the spinnerette orifices;

d) a first independently controllable blower mounted for directing air into the quench chamber to quench the molten filaments.

e) an attenuator positioned for receiving the filaments and the quench air and configured for pneumatically attenuating and stretching the filaments;

f) a filament depositing unit;

g) a moving continuous air-permeable belt positioned for having randomly deposited thereon the filaments from the depositing unit to form a nonwoven web of substantially continuous filaments;

h) a second independently controllable blower positioned beneath the air-permeable belt so as to draw air through the depositing unit and through the air-permeable belt; and i) a bonder for bonding the filaments and to form therefrom a coherent nonwoven fabric.

In a specific embodiment, the initial handling, melting, and forwarding of the two or more polymer components is carried out in respective individual extruders. The separate polymer components are combined and extruded as multicomponent filaments with the use of a spin beam assembly equipped with spin packs having a unique distribution plate arrangement available from Hills, Inc. and described in U.S. Pat. Nos. 5,162,074; 5,344,297 and 5,466,410. The extruded filaments are quenched, attenuated and deposited onto a moving air-permeable conveyor belt using a system known as the Reicofil III system, as described in U.S. Pat. No. 5,814,349. The web of filaments which is formed on the conveyor belt may be bonded, either in this form or in combination with additional layers or components, by passing through a bonder. The bonder may comprise a heated calender having a patterned calender roll which forms discrete point bonds throughout the fabric. Alternatively, the bonder may comprise a through-air bonder. The fabric is then wound into roll form using a commercially available take-up assembly

BRIEF DESCRIPTION OF THE DRAWING

The drawing FIGURE shows schematically an arrangement of system components for producing a bicomponent spunbonded nonwoven fabric in accordance with the present invention.

DETAILED DESCRIPTION OF THE INVENTION

Figure 1:
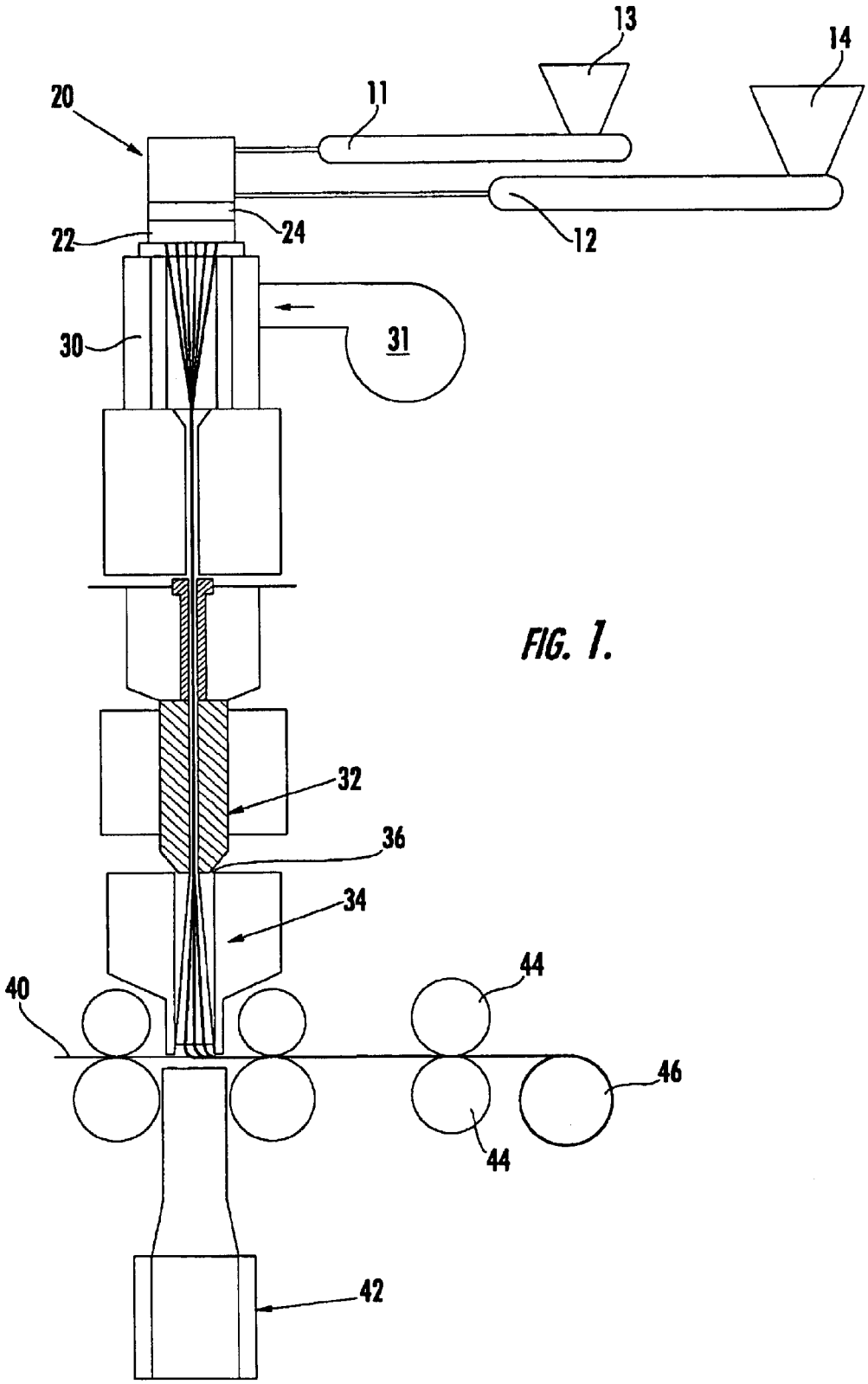

The present invention now will be described more fully hereinafter with reference to the accompanying drawing, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

The drawing FIGURE schematically illustrates the system components for carrying out the process of the present invention. In the illustrated embodiment, the system includes two extruders 11, 12 adapted for receiving and processing two separate fiber-forming polymer materials, typically received from the manufacturer in the form of polymer chip or flake. The extruders are equipped with inlet hoppers 13, 14 adapted for receiving a supply of polymer material. The extruders include a heated extruder barrel in which is mounted an extruder screw having convolutions or flights configured for conveying the chip or flake polymer material through a series of heating zones while the polymer material is heated to a molten state and mixed by the extruder screw. Extruders of this type are commercially available from various sources.

A spin beam assembly, generally indicated at 20, is communicatively connected to the discharge end of each extruder for receiving molten polymer material therefrom. The spin beam assembly 20 extends in the cross-machine direction of the apparatus and thus defines the width of the nonwoven fabric to be manufactured. The spin beam assembly is typically several meters in length. Mounted to the spin beam assembly is one or more replaceable spin packs designed to receive the molten polymer material from the two extruders, to filter the polymer material, and then to direct the polymer material through fine capillaries formed in a spinnerette plate. The polymer is extruded from the capillary orifices under pressure to form fine continuous filaments. It is important to the present invention to provide a high density of spinnerette orifices. Preferably the spinnerette should have a density of at least 3000 orifices per meter of length of the spin beam, and more desirably at least 4000 orifices per meter. Hole densities as high as 6000 per meter are contemplated.

Each spin pack is assembled from a series of plates sandwiched together. At the downstream end or bottom of the spin pack is a spinnerette plate 22 having spinnerette orifices as described above. At the upstream end or top is a top plate having inlet ports for receiving the separate streams of molten polymer. Beneath the top plate is a screen support plate for holding filter screens that filter the molten polymer. Beneath the screen support plate is a metering plate having flow distribution apertures formed therein arranged for distributing the separate molten polymer streams. Mounted beneath the metering plate and directly above the spinnerette plate 22 is a distribution plate 24 which forms channels for separately conveying the respective molten polymer materials received from the flow distribution apertures in the metering plate above. The channels in the distribution plate are configured to act as pathways for the respective separate molten polymer streams to direct the polymer streams to the appropriate spinnerette inlet locations so that the separate molten polymer components combine at the entrance end of the spinnerette orifice to produce a desired geometric pattern within the filament cross section. As the molten polymer material is extruded from the spinnerette orifices, the separate polymer components occupy distinct areas or zones of the filament cross section. For example, the patterns can be sheath/core, side-by-side, segmented pie, islands-in-the-sea, tipped profile, checkerboard, orange peel, etc. The spinnerette orifices can be either of a round cross section or of a variety of cross sections such as trilobal, quadralobal, pentalobal, dog bone shaped, delta shaped, etc. for producing filaments of various cross section. The thin distributor plates 24 are easily manufactured, especially by etching, which is less costly than traditional machining methods. Because the plates are thin, they conduct heat well and hold very low polymer volume, thereby reducing residence time in the spin pack assembly significantly. This is especially advantageous when extruding polymeric materials which differ significantly in melting points, where the spin pack and spin beam must be operated at temperatures above the melting point of the higher melting polymer. The other (lower melting) polymer material in the pack experiences these higher temperatures, but at a reduced residence time, thus aiding in reducing degradation of the polymer material. Spin packs using distributor plates of the type described for producing bicomponent or multi-component fibers are manufactured by Hills Inc. of W. Melborne Fla., and are described in U.S. Pat. Nos. 5,162,074, 5,344,297 and 5,466,410, the disclosures of which are incorporated herein by reference.

Upon leaving the spinnerette plate, the freshly extruded molten filaments are directed downwardly through a quench chamber 30. Air from an independently controlled blower 31 is directed into the quench chamber and into contact with the filaments in order to cool and solidify the filaments. As the filaments continue to move downwardly, they enter into a filament attenuator 32. As the filaments and quench air pass through the attenuator, the cross sectional configuration of the attenuator causes the quench air from the quench chamber to be accelerated as it passes downwardly through the attenuation chamber. The filaments, which are entrained in the accelerating air, are also accelerated and the filaments are thereby attenuated (stretched) as they pass through the attenuator. The blower speed, attenuator channel gap and convergence geometry are adjustable for process flexibility.

Mounted beneath the filament attenuator 32 is a filament-depositing unit 34 which is designed to randomly distribute the filaments as they are laid down upon an underlying moving endless air-permeable belt 40 to form an unbonded web of randomly arranged filaments. The filament-depositing unit 34 consists of a diffuser with diverging geometry and adjustable side walls. Beneath the air-permeable belt 40 is a suction unit 42 which draws air downwardly through the filament-depositing unit 34 and assists in the lay-down of the filaments on the air-permeable belt 40. An air gap 36 is provided between the lower end of the attenuator 32 and the upper end of the filament depositing unit 34 to admit ambient air into the depositing unit. This serves to facilitate obtaining a consistent but random filament distribution in the depositing unit so that the nonwoven fabric has good uniformity in both the machine direction and the cross-machine direction.

The quench chamber, filament attenuator and filament-depositing unit are available commercially from Reifenhauser GmbH & Company Machinenfabrik of Troisdorf, Germany. This system is described more fully in U.S. Pat. No. 5,814,349, the disclosure of which is incorporated herein by reference. This system is sold commercially by Reifenhauser as the "Reicofil III" system.

The web of filaments on the continuous endless moving belt may be subsequently directed through a bonder and bonded to form a coherent nonwoven fabric. Bonding may be carried out by any of a number known techniques such as by passing through the nip of a pair of heated calender rolls 44 or a through-air bonder. Alternatively, the web of filaments may be combined with one or more additional components and bonded to form a composite nonwoven fabric. Such additional components may include, for example, films, meltblown webs, or additional webs of continuous filaments or staple fibers. The polymer components for multicomponent filaments are selected in proportions and to have melting points, crystallization properties, electrical properties, viscosities, and miscibilities that will enable the multicomponent filament to be melt-spun and will impart the desired properties to the nonwoven fabric. Suitable polymers for practice of the invention include polyolefins, including polypropylene and polyethylene, polyamides, including nylon, polyesters, including polyethylene terephthalate and polybutylene terephthalate, thermoplastic elastomers, copolymers thereof, and mixtures of any of these.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A process for producing spunbond nonwoven fabric, comprising the steps of:

separately melting two or more polymeric components;

separately directing the two or more molten polymer components through a spin beam assembly equipped with a distribution plate configured so that the separate molten polymer components combine at a multiplicity of spinnerette orifices to form filaments containing the two or more polymer components;

extruding the multicomponent filaments from the spinnerette orifices into a quench chamber;

directing quench air from a first independently controllable blower into the quench chamber and into contact with the filaments to cool and solidify the filaments;

directing the filaments and the quench air into and through a filament attenuator and pneumatically attenuating and stretching the filaments;

directing the filaments from the attenuator into and through a filament depositing unit;

depositing the filaments from the depositing unit randomly upon a moving continuous air-permeable belt to form a nonwoven web of substantially continuous filaments;

applying suction from a second independently controllable blower beneath the air-permeable belt so as to draw air through the depositing unit and through the air-permeable belt; and directing the web through a bonder and bonding the filaments to convert the web into a coherent nonwoven fabric.

2. The process according to claim 1, wherein the two or more polymer components are arranged in a cross-sectional configuration selected from sheath core, side by side, segmented pie, islands-in-the-sea, or tipped profile.

3. The process according to claim 1, wherein one polymer component is polyethylene and another polymer component is polypropylene.

4. The process according to claim 1, wherein two polymer component are directed through the spin beam assembly and are combined at the spinnerette orifices to form sheath-core bicomponent filaments, and wherein one of the polymer components is polypropylene and the other polymer component is a polymer having different properties from said polypropylene polymer component.

5. The process according to claim 1, wherein said extruding step comprises extruding the filaments through spinnerette orifices arranged at a density of at least 3000 orifices per meter.

6. A process for producing a spunbond nonwoven fabric, comprising the steps of:

separately melting first and second polymeric components;

separately directing the first and second molten polymer components through a spin beam assembly equipped with distribution plate configured so that the separate molten polymer components combine at a multiplicity of spinnerette orifices to form bicomponent filaments containing a core of the first polymer component and a surrounding sheath of the second polymer component, the spinnerette orifices being arranged at a density of at least 3000 orifices per meter;

extruding the bicomponent filaments from the spinnerette orifices into a quench chamber;

directing quench air from a first independently controllable blower into the quench chamber and into contact with the filaments to cool and solidify the filaments;

directing the filaments and the quench air into and through a filament attenuator and pneumatically attenuating and stretching the filaments;

directing the filaments from the attenuator into and through a filament depositing unit;

depositing the filaments from the depositing unit randomly upon a moving continuous air-permeable belt to form a nonwoven web of substantially continuous filaments;

applying suction from a second independently controllable blower beneath the air-permeable belt so as to draw air through the depositing unit and through the air-permeable belt; and directing the web through a bonder and bonding the filaments to convert the web into a coherent nonwoven fabric.

7. The process according to claim 6, wherein the first polymer component is polypropylene and the second polymer component is polyethylene.

8. The process according to claim 6, wherein the first polymer component is polypropylene and the second polymer component is a different polypropylene.

9. The process according to claim 6, wherein the step of directing the web through a bonder comprises directing the web through a calender including a patterned calender roll and forming discrete point bonds throughout the fabric.

10. A system for manufacturing spunbond nonwoven fabric which includes:

two or more extruders for separately melting, respectively, two or more polymer components;

a spin beam assembly connected to said extruders for separately receiving the molten polymers components therefrom;

said spin beam assembly including a spinnerette plate defining a multiplicity of spinnerette orifices, and a distribution plate configured so that the separate molten polymer components combine at the spinnerette orifices to form multicomponent filaments;

a quench chamber positioned adjacent to the spin plate for receiving filaments extruded from the spinnerette orifices; and a first independently controllable blower mounted for directing air into the quench chamber and into contact with the filaments to cool and solidify the filaments;

an attenuator positioned for receiving the filaments and the quench air and configured for pneumatically attenuating and stretching the filaments;

a filament depositing unit;

a moving continuous air-permeable belt positioned for having randomly deposited thereon the filaments from the depositing unit to form a nonwoven web of substantially continuous filaments;

a second independently controllable blower positioned beneath the air-permeable belt so as to draw air through the depositing unit and through the air-permeable belt; and a bonder for bonding the filaments and to form therefrom a coherent nonwoven fabric.

11. The system according to claim 10, wherein said distribution plate is configured so that the separate molten polymer components combine in a cross-sectional configuration selected from sheath core, side by side, segmented pie, islands-in-the-sea, tipped profile.

12. The system according to claim 10, wherein said spinnerette has orifices arranged at a density of at least 3000 orifices per meter.

13. A system for manufacturing spunbond nonwoven fabric which includes:

first and second extruders for separately melting first and second polymer components;

a spin beam assembly connected to said extruders for separately receiving the molten polymers components therefrom;

said spin beam assembly including a spinnerette plate defining a multiplicity of spinnerette orifices arranged at a density of at least 3000 orifices per meter, and a distribution plate configured so that the separate molten polymer components combine at the spinnerette orifices to form bicomponent filaments having a core formed of the first polymer component and a surrounding sheath formed of the second polymer component;

a quench chamber positioned adjacent to the spin plate for receiving filaments extruded from the spinnerette orifices; and a first independently controllable blower mounted for directing air into the quench chamber and into contact with the filaments to cool and solidify the filaments;

an attenuator positioned for receiving the filaments and the quench air and configured for pneumatically attenuating and stretching the filaments;

a filament depositing unit;

a moving continuous air-permeable belt positioned for having randomly deposited thereon the filaments from the depositing unit to form a nonwoven web of substantially continuous filaments;

a second independently controllable blower positioned beneath the air-permeable belt so as to draw air through the depositing unit and through the air-permeable belt; and a bonder for bonding the filaments and to form therefrom a coherent nonwoven fabric.

14. The system according to claim 13, wherein the first polymer component is polypropylene and the second polymer component is polyethylene.

15. The system according to claim 13, wherein the first polymer component is polypropylene and the second polymer component is a different polypropylene.

16. The system according to claim 13, wherein the bonder comprises a calender including a patterned calender roll which forms discrete point bonds throughout the fabric.

* * * * *